US005622531A

United States Patent [19]

Yamada et al.

[11] Patent Number: 5,622,531

[45] Date of Patent: Apr. 22, 1997

[54] POLYURETHANE FIBER-CONTAINING TEXTILE PRODUCT IMPROVED IN SWEAT ABSORPTION/EXHALATION PROPERTIES, AND PRODUCTION THEREOF

[75] Inventors: Masaru Yamada, Aichi-ken; Kiyokazu Shuku, Nara-ken; Toshio Hagihara, Kawachinagano, all of Japan

[73] Assignees: Kurashiki Boseki Kabushiki Kaisha, Kurashiki; Okamoto Corporation, Nara-ken; Consumer Product End-Use Research Institute Co., Ltd., Osaka, all of Japan

[21] Appl. No.: 542,877

[22] Filed: Oct. 13, 1995

[30] Foreign Application Priority Data

Aug. 10, 1995 [JP] Japan ..... 7-204361

[51] Int. Cl.[6] ..... D06M 10/08; D02G 3/36

[52] U.S. Cl. ..... 8/115.66; 8/115.65; 427/414; 428/378; 428/396; 428/394; 428/375; 428/364

[58] Field of Search ..... 8/115.56, 115.65, 8/115.66, 128.1; 252/8.8; 428/361, 365, 364, 375, 378, 392, 394, 396; 427/394, 414, 415, 417

[56] References Cited

U.S. PATENT DOCUMENTS 5,276,138 1/1994 Yamada et al. ..... 530/357

5,290,905 3/1994 Komiya et al. ..... 528/80

FOREIGN PATENT DOCUMENTS 3-269172 11/1991 Japan .
4-185770 7/1992 Japan .
5-117972 5/1993 Japan .
6-010268 1/1994 Japan .

OTHER PUBLICATIONS

English language abstract of Japanese Patent KOKAI No. Hei 3–269172, Patent Abstracts of Japan, Nov. 29, 1991.

English language abstract of Japanese Patent KOKAI No. Hei 4–185770, Patent Abstracts of Japan Jul. 2, 1992.

English language abstract of Japanese Patent KOKAI No. Hei 5–117972, Patent Abstract of Japan May 14, 1993.

English language abstract of Japanese Patent KOKAI No. Hei 6–10268, Patent Abstracts of Japan, Jan. 18, 1994.

*Primary Examiner*—Prince Willis, Jr.
*Assistant Examiner*—Alan D. Diamond
*Attorney, Agent, or Firm*—Birch, Stewart, Kolasch & Birch, LLP

[57] ABSTRACT

The present invention relates to a process for producing fibers or a textile product, in which fibers or textile products containing polyurethane fibers are dipped in a water-soluble wool protein solution to selectively adsorb a wool protein on the polyurethane fibers.

13 Claims, 8 Drawing Sheets

POLYURETHANE FIBER-CONTAINING TEXTILE PRODUCT IMPROVED IN SWEAT ABSORPTION/EXHALATION PROPERTIES, AND PRODUCTION THEREOF

BACKGROUND OF THE INVENTION

The present invention relates to a modification of fibers or a textile product containing polyurethane fibers. More particularly, it relates to a process for modifying a stuffy feeling caused by a hydrophobic nature of the fibers or textile product in case of contacting directly with skin.

We are now entering an era where functional characteristics of textile products, such as form stability, become a matter of great concern. Panty hose representing leg knits are composed of hydrophobic synthetic fibers such as nylon, polyurethane, etc. and a stuffy feeling caused by directly contacting with skin becomes a large problem. That is, a humidity between panty hose and skin increases rapidly at the beginning of perspiration. In addition, even if perspiration is stopped, high humidity is maintained, thereby affording an unpleasant feeling.

Heretofore, softeners and oils having no water repellency have been used for improving these disadvantages. However, properties of hydrophobic fibers per se are not improved and satisfactory water absorption properties can not be obtained by this method. There is also a suggestion to impart a protein, which is easily dissolved in water, such as gelatin, collagen, sericin, etc. so as to further improve water absorption properties. However, the product obtained by these methods is inferior in washing fastness and does not afford a pleasant feeling; on the contrary it affords a sticky feeling at a state of considerably high humidity. In addition, a method of imparting a water-soluble hard protein to panty hose has been suggested for the purpose different from that of the present invention (Japanese Patent Application KOKAI No. 3-269172). In this method, the hard protein is easily dissolved in water and, therefore, it is highly hydrolyzed and the molecular weight of its peptide becomes considerably small. Accordingly, the hard protein is not much different from the above protein, as far as sweat absorption/exhalation properties are concerned.

As described above, in the method which has hitherto been suggested, the substance used for imparting water absorption properties is considerably different from the outer-most component (horny component) of skin. Therefore, an excellent skin feeling is hardly obtained. Furthermore, a water absorbing component is merely imparted, excessively, and a balance between the hydrophilic nature and hydrophobic nature is not taken into consideration at all.

SUMMARY OF THE INVENTION

An object of the present invention is to provide fibers or a textile product comprising polyurethane fibers, which have sweat absorption/exhalation properties similar to those of skin and afford a pleasant wear feeling, and a process for producing the same.

In order to achieve the above object polyurethane fibers are imparted with a wool protein, by which the polyurethane fibers are improved in an affinity with skin and good sweat absorption properties, and the wool protein has a high affinity with polyurethane fibers in comparison with other hydrophobic fibers which constitute a processed yarn, together with polyurethane fibers or which are mixed-woven or knitted together with polyurethane fibers, and the wool protein is selectively adsorbed on polyurethane fibers.

BRIEF DESCRIPTION OF THE DRAWINGS

FIG. 1 (*a*) is an electron micrograph illustrating a yarn after subjecting to a wool protein imparting treatment (no preliminary treatment: Example 2, 750× magnification).

FIG. 1 (*b*) is an electron micrograph illustrating a yarn after subjecting to a wool protein imparting treatment (preliminary treatment using chitosan: Example 1, 800× magnification).

FIG. 1 (*c*) is an electron micrograph illustrating a state of the yarn of FIG. 1 (*b*) after subjecting to a washing treatment five times (800× magnification).

FIG. 1 (*d*) is an electron micrograph illustrating a non-treated yarn (750× magnification).

FIG. 3 (A) is a graph illustrating test results under a constant humidity (75% RH), wherein (a) is the present invention (Example 3) and (b) is Comparative Example 2.

FIG. 3 (B) is a graph illustrating test results under a constant temperature (25° C.), wherein (a) is the present invention (Example 3) and (b) is Comparative Example 2.

DETAILED DESCRIPTION OF THE INVENTION

Figure 1:
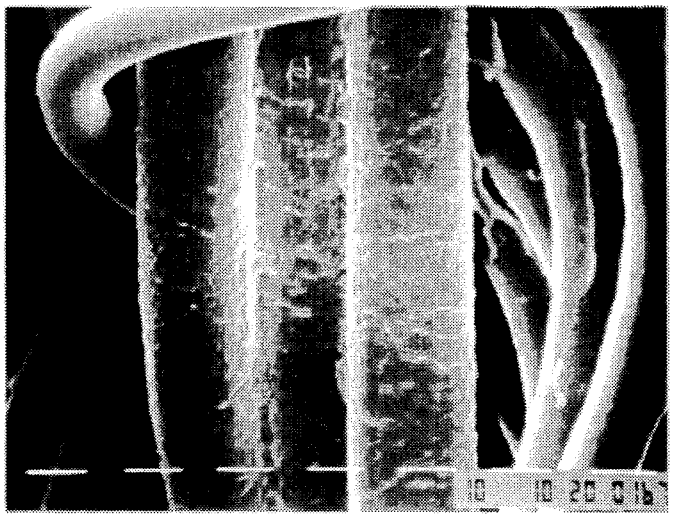
FIGS. 1 (*a*) to (*d*) are electron micrographs illustrating a difference in imparting state of a wool protein to polyurethane fibers and nylon.
Figure 1:
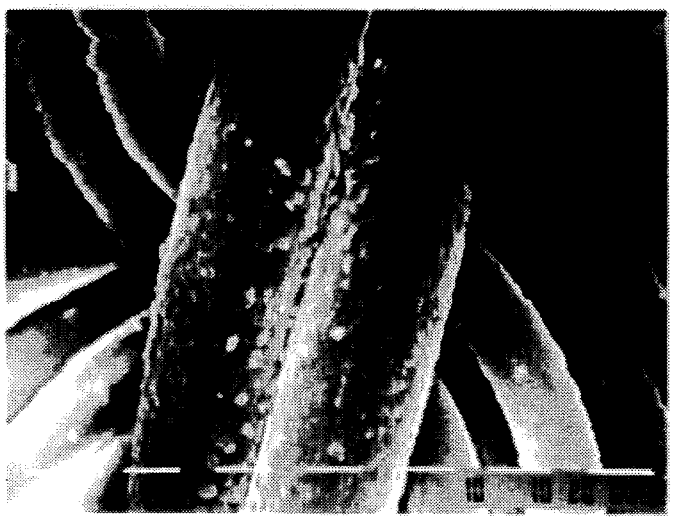
Figure 1:
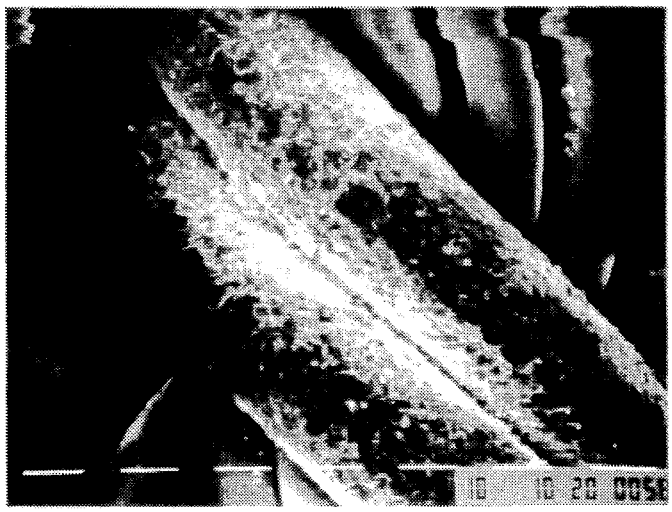
Figure 1:
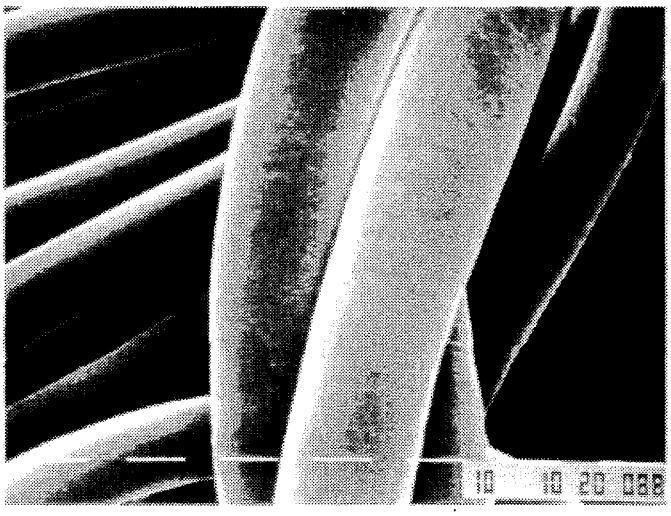

The present invention relates to fibers or a textile product comprising polyurethane fibers on which a wool protein is imparted.

More particularly, it relates to the above fibers or textile product, wherein the wool protein is a water-soluble wool protein obtained by subjecting a wool to oxidation cleavage in a weak alkaline liquid medium containing an oxidizing agent having a comparatively high concentration.

Also, the present invention relates to a process for producing fibers or a textile product, which comprises dipping fibers or a textile product containing polyurethane fibers in a water-soluble wool protein solution to selectively adsorb a wool protein on polyurethane fibers.

More particularly, it relates to the above process, wherein the fibers or textile product containing polyurethane fibers are subjected to a preliminary treatment by dipping in a chitosan solution before dipping in a water-soluble protein solution, or chitosan is allowed to be present in the wool protein solution.

The features of the present invention are as follows.

(1) Sweat absorption properties and a skin feeling are imparted to the surface of polyurethane fibers by adsorbing a wool protein, which is the same as or extremely similar to the horny layer of skin, on the surface of polyurethane fibers.
(2) By selectively adsorbing a wool protein on only polyurethane fibers in fibers constituting fibers or a textile product containing polyurethane fibers, particularly leg knit, excellent sweat absorption/exhalation properties having a good balance between a hydrophobic nature and a hydrophilic nature can be obtained in cooperation with a hydrophobic component as the other constituent component, thereby providing a polyurethane fiber-containing textile product, particularly leg knit, which affords no stuffy feeling and has a good wear feeling.

These features of the present invention can be accomplished by using a wool protein prepared according to the technique disclosed in Japanese Patent Application KOKAI No. 4-126724 and U.S. Pat. No. 5,276,138, i,e, water-soluble protein obtained by subjecting a wool to oxidation cleavage in a weak alkaline liquid medium containing an oxidizing agent having a comparatively high concentration, as the wool protein.

The leg knit using polyurethane fibers is made by mixed-knitting of a remaindered type knit produced by using a processed yarn consisting of polyurethane fibers and nylon or polyester, or such a processed yarn and other synthetic fibers (mainly, nylon or polyester). As is clearly observed in the scanning electron micrograph of FIG. 1, when such a leg knit is brought into contact with a wool protein solution, this protein is selectively adsorbed on polyurethane fibers (comparatively thick fibers in the electron micrograph) and is hardly adsorbed on nylon or polyester fibers as the other material.

The mechanism of this adsorption is assumed that polyamide bonds of nylon fibers are arranged so that adjacent molecular chains eliminate an ion pair to form a comparatively dense structure. Accordingly, it is considered that apparent cationic properties of the amide bond are deteriorated and nylon fibers are inferior in interaction with an anionic protein having a large molecular weight to be used in the present invention. On the other hand, it is considered that polyurethane fibers have not an amide bond but an urethane bond and, therefore, cationic properties are not deteriorated and they have an affinity with the above protein. Accordingly, as the yarn to be used in the present invention, a covered yarn of polyurethane fibers and nylon is preferred.

The fibers or textile products containing wool protein-absorbed polyurethane fibers thus produced exhibits wear pleasant properties as follows. That is, they rapidly absorb sweat by polyurethane fibers having water absorption properties and a capillary action of other hydrophobic fibers to promote exhalation. In the leg knit using polyurethane fibers, the water absorbing part and hydrophobic part are directly brought in contact with skin by repeating expansion and contraction which are generated at the time of wearing and, therefore, sweat absorption/exhalation are effectively carried out.

As the liquid medium to be used for a method for oxidative destruction of a wool to obtain the wool protein of the present invention, water and alcohols (e.g. methanol, ethanol, propanol, etc.) are normally used, and these may be optionally used in combination.

Examples of the pH adjustor for making these liquid mediums to weak alkaline include ammonia, alkaline metal hydroxides, amines, alkaline metal carbonates, etc. These may be appropriately selected according to the kind of liquid mediums and oxidizing agents to be used.

Examples of the oxidizing agent include peroxides such as hydrogen peroxide, peracetic acid, performic acid, etc. Among them, hydrogen peroxide is most preferred because it is cheap and easily handled and, further, a post-treatment after a dissolution treatment of the wool is easily carried out and no harmful component is remained in a solubilized material.

The concentration of the oxidizing agent is normally not less than 20%, preferably 25 to 35%.

The solubilization of the wool varies depending on the kind and concentration of the oxidizing agent and kind of the dissolving medium to be used, and the solubilizing time is normally about 0.1 to 1.0 hour. For example, when using treated water of which pH was adjusted to about 8 using 35% hydrogen peroxide and ammonia, the temperature naturally increase to about 100° C. when the wool is dipped in it, and the solubilization will be completed within one hour and a non-dissolved material is hardly remained.

In this production process, cystine is subjected to oxidation cleavage to form a cysteic acid. A sulfoxide group contained in cysteic acid acts as a dissolution point of the protein and, at the same time, it has an ionic bonding-like affinity between a cationic functional group and a film-forming substance. Therefore, it is expected to be absorbed, comparatively firmly. According to this preparation process, the horny protein is not exposed to a crushing chemical change and, therefore, the amino acid composition is almost the same as that of wool fibers. As is disclosed in Japanese Patent Application KOKAI No. 5-70339, it can also be used as a cosmetic composition and, therefore, it has no problem in safety.

As is disclosed in Japanese Patent Application KOKAI No. 4-126724 and U.S. Pat. No. 5,276,138, a pure wool protein can be recovered as a solid (powder). However, the wool protein may be used in the form of solution in the present invention, and it is not necessary to recover it as the solid. Fundamentally, it is also possible to dissolve the protein recovered as the powder again to reuse, excluding the problem of cost. Accordingly, in the present invention, a wool protein solution is prepared by using an ultrafiltration technique, as a method which is easily derived from the technique disclosed above. That is, a wool protein solution, which can be used as it is in the present invention, is prepared by diluting an aqueous wool protein solution obtained by subjecting to oxidation cleavage with water, adjusting pH and removing an oxidizing agent residue using an ultrafiltration technique. It was confirmed by the data of a liquid chromatography that the molecular weight of the wool protein thus obtained is several thousands to several hundred thousands and its peak is about 30,000.

The present invention is accomplished by imparting the wool protein thus obtained to the textile product composed of polyurethane fibers. As the imparting method, there can be widely used padding method, dipping method, adsorption method, etc. The amount of the wool protein to be imparted (conversion based on solid content) is normally 0.1 to 5.0% by weight, for the leg knit composed of polyurethane/nylon. When the amount is less than 0.1% by weight, the effect of water absorption properties is insufficient. On the other hand, when it exceeds 5.0% by weight, a set line is formed in the leg knit in the finishing step, and it is not preferred.

It has an effect for improving a washing fastness of the wool protein to be imparted hereinafter to treat with a chemical for increasing cationic properties of polyurethane fibers before the wool protein is imparted. Examples of the chemical to be used for such a preliminary treatment include cationizing agent, chitosan, etc. However, it is necessary to make the treating bath to strong alkaline so as to carry out a cationization treatment using a cationizing agent, but it is not necessarily preferred because physical properties of polyurethane fibers are deteriorated. Most preferred preliminary treating agent is chitosan.

The treatment due to a preliminary treating agent may be carried out by impregnating a fiber or textile product to be treated with a preliminary treating agent solution before dipping in a wool protein solution and then transferring it to the wool protein solution as it is. However, the effect of both preliminary treatment and wool protein treatment can be easily obtained only by dipping a product to be treated in a solution containing chitosan and wool protein. Chitosan itself can be dissolved in an aqueous citric acid solution (pH 3 to 4) to form an aqueous solution. Chitosan forms a fine suspension with the wool protein in a bath to make the solution cloudy. However, by introducing a leg knit containing polyurethane fibers in this bath, followed by heating to about 50° C., a cloudy treating bath becomes transparent completely, thereby adsorbing it on polyurethane fibers. It is assumed that the suspension is broken to form a hydrophobic bond with polyurethane. However, the details are not apparent. Anyway, the washing resistance becomes good by the preliminary treatment and the wool protein is selectively imparted on polyurethane fibers.

The amount of the preliminary treating agent is preferably 1 to 10% by weight, particularly 2 to 7% by weight, based on the amount of polyurethane fibers (conversion based on chitosan solid content).

Antibacterial properties are imparted to the fibers and textile product obtained by treating with the wool protein and chitosan of the present invention.

The product obtained by using chitosan alone in the amount defined in the present invention shows no antibacterial properties, but the product obtained by using the wool protein in combination with chitosan has excellent antibacterial properties. The details of this mechanism are not apparent, but it is considered that antibacterial properties are obtained when a lot of amino groups are contained in both wool protein and chitosan.

The polyurethane fibers to be used in the present invention are elastic fibers having the urethane bond or urethane bond and urea bond in the molecular chain, and mean those which are referred to as "spandex". This is the fibers produced by dissolving a linear block copolymer having a chemical structure comprising a hard segment having a high melting point and a flexible soft segment having a glass transition temperature of not more than room temperature in a suitable solvent, followed by dry or wet spinning, or dissolving the linear block copolymer as it is, followed by melt spinning. The polymer constituting the fibers is normally produced by using a high-molecular weight diol having a low melting point and a low glass transition point, a diioscyanate and a low-molecular weight difunctional active hydrogen compound referred to as a chain extender as a main raw material. As the high-molecular weigh diol, polyester diol, polyether diol, polycarbonate diol or a copolymerized material thereof is used. In addition, as the diisocyanate, for example, aromatic diisocyanates such as tolylene diisocyanate (TDI), 4,4-diphenylmethane diisocyanate (MDI), etc.; aliphatic diisocyanates such as hexamethylene diisocyanate, etc.; cyclic aliphatic diisocyanates such as isophorone diisocyanate, etc. are normally used.

The polyurethane fibers are hardly used alone, and used as a processed yarn such as covered yarn wherein other normal fibers, particularly nylon or polyester fibers, are spirally wound on polyurethane. Not only such a processed yarn is used alone, but also it is subjected to mixed-knitting or weaving together with other materials to make a textile product. In case of leg knit, a cover yarn is exclusively made of nylon. In case of mixed-knitting or weaving, another material is also exclusively made of nylon.

Examples

The following Examples further illustrate the present invention in detail.

Preparation of Wool Protein Solution

Degreased and washed wool fibers of Merino species (20 kg) were dipped in an aqueous 30% (by weight) hydrogen peroxide (100 L) of which pH was adjusted to 8 using an aqueous ammonia. After 10 minutes, a severe heat generation and foaming arose naturally and almost all of wool fibers were dissolved completely after 40 minutes. Trace amounts of an insoluble residue was removed by filtration to give 110 L of a wool solution. The resulting wool solution was diluted with water containing sodium hydroxide and ammonium sulfate to make 1000 L of a solution (pH 8.5). Thereafter, it was subjected to ultrafiltration using a hollow fiber membrane having a fractional molecular weight of 3000 to give 200 L of a wool solution. Operations such as dilution and concentration due to ultrafiltration were repeated to reduce the concentration of hydrogen peroxide. Since the protein solution is liable to deposit as a solid during this dilution/concentration operation, pH was adjusted to 7 to 9 using an aqueous sodium hydroxide and an aqueous ammonium sulfate solution every operation. Finally, 300 L of a wool protein solution containing the above chemical (concentration of residual hydrogen peroxide: about 5 mg/L) was obtained. In order to enhance a storage stability of the solution, a polyethylene glycol nonionic surfactant was added so that the concentration became 1 g/L.

The concentration of the residual hydrogen peroxide is small such as about 5 mg/L and it is considerably small in comparison with a normal amount of hydrogen peroxide contained in a textile product as a final product, thereby causing no problem in safety.

Figure 2:
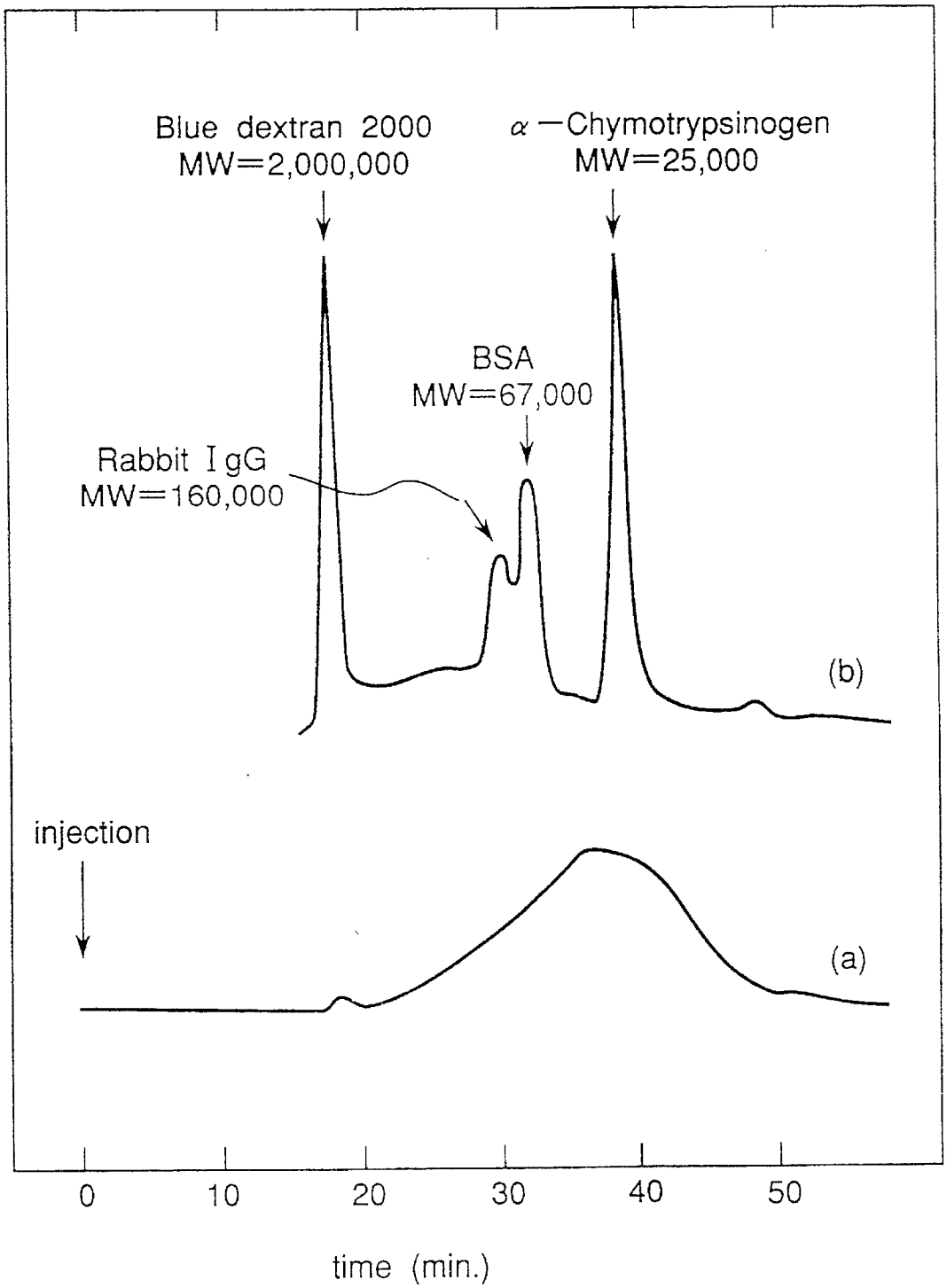
FIG. 2 is a graph illustrating a liquid chromatogram of a wool protein, wherein (a) is a liquid chromatogram of a water-soluble wool protein of the present invention and (b) is that of a protein of which molecular weight is known.

A part of the wool protein solution obtained finally was introduced in alcohol to precipitate a wool protein as a solid powder, which was recovered and dissolved in 0.1M borate buffer (pH 9). Then, a molecular weight distribution was measured in comparison with the other protein having a known molecular weight by subjecting to a liquid chromatography [measuring apparatus: HPLC (=High Performance Liquid Chromatography) Superose, 12HR 10/30 column, manufactured by Farmacia Fine Chemical Co.]. As a result, the molecular weight of the main component was within a range of several thousands to several hundred thousands and its peak was about 30,000, as shown in FIG. 2. Incidentally, as the protein having a known molecular weight, Blue dextran 2000 (molecular weight: 2,000,000), Rabbit IgG (molecular weight: 160,000), Bovine Serum Albumin (BSA, molecular weight: 67,000) and α-Chymotrypsin (molecular weight: 25,000) were used.

Imparting of Wool Protein to Textile Product

Example 1

As the textile product, panty hose according to the following specification were used.

Panty Hose

Panty part: Mixed-knit of 30/30 FTY (filament textured yarn) and 50/-17F WN (wooly nylon), mixing ratio of polyurethane fibers: about 8%

Leg part: remaindered type of 15/12-7F SCY (single covered yarn), mixed ratio of polyurethane fibers: about 25%

Nylon yarn: "Miracosmo"* (*: registered trademark) manufactured by Toray Co., Ltd.

Polyurethane yarn: "Opelon"* manufactured by Toray Du Pont Co., Ltd.

Figure 9:
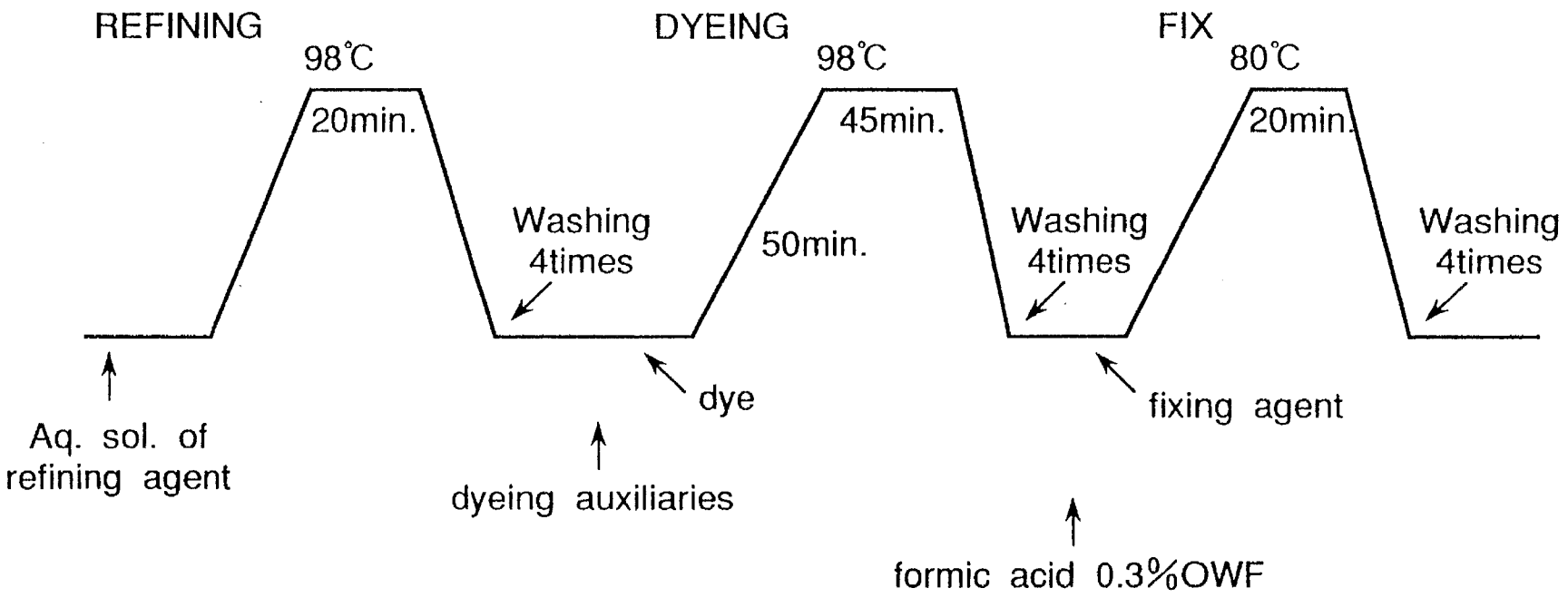
FIG. 9 is a flow chart illustrating a standard dyeing process (refining-dyeing-fixing).

The above panty hose (80 kg) were refined and dyed according to a usual method, using an Over Mayer dyeing apparatus (a flow chart of a dyeing process in series is shown in FIG. 9). In the refining process, the panty hose is dipped into an aqueous solution of a refining agent such as Sunmorl* WX-24 3.5% OWF (available from Nicca Kagaku Co., Ltd.) at 98° C. and kept for 20 minutes; washed by water 4 times with complete substitution of washing water; dipped into an aqueous dyeing auxiliaries (e.g. Sandogen* PLK (available from Sandoz) 15% OWF, Clewat* $N_2$ (Teikoku Kagaku K.K.) 0.2% OWF and ammonium sulfate 3% OWF); and then into a dyeing solution (e.g. Nylosan* (available from Sandoz) X%); heated to 98° C. over 50 minutes and kept at 45 minutes; washed 4 times with complete substitution with fresh water, added with aqueous solution of formic acid 0.3% OWF; and then the dyed panty hose is dipped into an aqueous solution of fixing agent (e.g. aromatic oxysulfonate, OK-U (Shichifuku Chemical Company LTD) 5% OWF) with increasing the temperature to 80° C., kept for 20 minutes, cooled, washed 4 times. Furthermore, panty hose were washed with water and treated with a chitosan solution ("Chitosan SK-10" manufactured by Koyo Chemical Co., Ltd. was dissolved in an aqueous citric acid solution to prepare a 5% (by weight) aqueous solution (pH 3 to 4)) (5% OWF) at a bath ratio of 1:10 at 50° C. for 30 minutes. Thereafter, waste water was removed using a centrifugal hydroextractor, followed by drying.

The panty hose subjected to a preliminary treatment with chitosan as described above was treated at a bath ratio of 1:8 at room temperature for 30 minutes in a drum dyeing apparatus equipped with a centrifugal hydroextractor capable of recovering a solution, which contains a solution prepared by diluting the wool protein solution prepared above with water in a ratio of 1:3 and adding 8 g/L of a softener ("Evafanol* N-33" manufactured by Nicca Kagaku Co., Ltd.). The treating solution was recovered and the panty hose were taken out from the dyeing apparatus. The pickup ratio of the treating solution onto the panty hose was 25% by weight. Thereafter, the panty hose were further subjected to a steam treatment at a vapor pressure of 0.8 kg/cm$^2$ for 10 seconds (using "TAS-150" manufactured by Takatori Co., Ltd.), followed by hot-air drying at 110° C. for 25 seconds to give a product.

Example 2

According to the same manner as that described in Example 1 except that the preliminary treatment due to chitosan is not carried out, a treatment of imparting a wool protein to the panty hose was carried out.

Example 3

According to the same manner as that described in Example 1, panty hose (80 kg) were refined, dyed and subjected to a fix treatment using an Over Mayer dyeing apparatus. and then washed with water and dehydrated using a centrifugal hydroextractor.

Then, water was charged in a drum dyeing apparatus so that the bath ratio became 1:10, and the chitosan solution prepared according to the same manner as that described in Example 1 and wool protein solution prepared above were respectively added (25% OWF and 15% OWF, conversion based on solution) to prepare a cloudy dispersed treating solution. Furthermore, 8% OWF of Evafanol* N-33 was added as the softener and the panty hose treated as described above was introduced in the resulting solution. The temperature was heated from normal at a rate of 1° C./minute and the panty hose were subjected to an adsorption treatment at 55° C. for 30 minutes. The turbidity of the cloudy dispersed treating solution began to decrease from about 50° C. during treatment. Finally, the solution became transparent completely and the situation of adsorption was observed. Thereafter, the panty hose were subjected to dehydration, steam set and drying to give a product subjected to wool protein imparting treatment.

Example 4

According to the same manner as that described in Example 3 except for using 8% OWF of Tendre YOMOGI*-7 (manufactured by Daiwa Kagaku Kogyo Co., Ltd.) in place of Evafanol* N-33 as the softener, a product subjected to wool protein imparting treatment was obtained.

Example 5

According to the same manner as that described in Example 1, a treatment of panty hose was carried out using the wool protein solution recovered in Example 1, repeatedly.

Comparative Example 1

According to the same manner as that described in Example 3 except that a treatment due to chitosan and wool protein was not carried out and a treating solution containing only Evafanol* N-33 as the softener was used, a product subjected to wool protein imparting treatment was obtained.

Comparative Example 2

According to the same manner as that described in Comparative Example 1 except for using an amino-modified silicon softener "Nicca Silicone* AMZ-3" (manufactured by Nicca Kagaku Co., Ltd.) in place of Evafanol* N-33 as the softener, panty hose were subjected to a normal treatment.

Comparative Example 3

According to the same manner as that described in Example 3 except for using no wool protein solution and adding 30% OWF of a chitosan solution, panty hose treated with chitosan was obtained.

Evaluation of Characteristics of Panty Hose After Treatment (1) Imparted State of Wool Protein The surface of the yarns at the leg part of Examples 1 and 2 were observed using a scanning electron microscope. FIG. 1 is an electron micrograph illustrating the surface shape thereof.

FIG. 1 (*a*) is an electron micrograph illustrating the surface shape of a yarn wherein a wool protein is imparted without subjecting to a preliminary treatment due to chitosan. FIG. 1 (*b*) is an electron micrograph illustrating the surface shape of a yarn wherein a wool protein is imparted after subjecting to the preliminary treatment due to chitosan of Example 1. FIG. 1 (*c*) is an electron micrograph illustrating the surface shape of a yarn obtained after subjecting the yarn of FIG. 1 (*b*) to a washing treatment. FIG. 1 (*d*) is an electron micrograph illustrating the surface shape of a yarn subjected to no wool protein treatment for comparison. It is confirmed that the wool protein is selectively adsorbed only on the surface of polyurethane fibers by the treatments of Examples 1 and 2, and that the wool protein of panty hose subjected to a preliminary treatment due to chitosan is held after washing.

Furthermore, regarding the surface of the yarn treated with a recovered wool protein solution of Example 5, adsorption of the wool protein was sufficiently observed in the yarn treated with the fifth recovered solution.

(2) Evaluation of Stuffy Feeling

In order to examine sweat adsorption/exhalation properties of panty hose due to wool protein treatment of the present invention, a climate in clothes between skin and panty hose on wearing of panty hose was measured using a temperature/humidity sensor.

As the sample, panty hose of Example 3 and Comparative Example 2 were used.

Figure 3A:
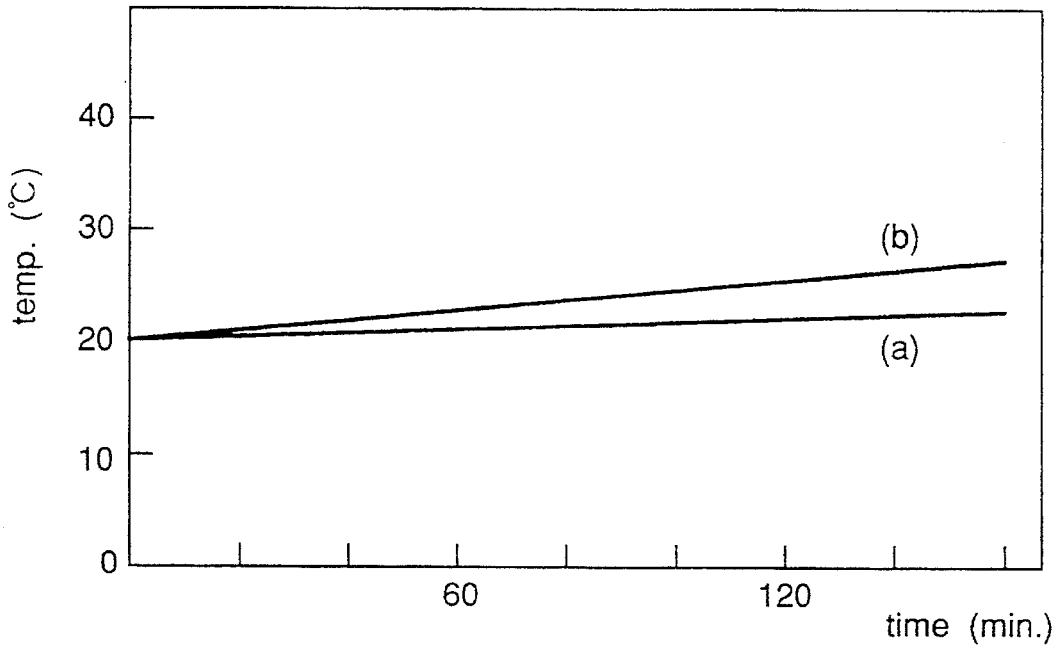
FIGS. 3 (A) and (B) are graphs illustrating a change in temperature and humidity with time between panty hose and skin, as a measure of sweat absorption/exhalation properties on wearing of panty hose.
Figure 3B:
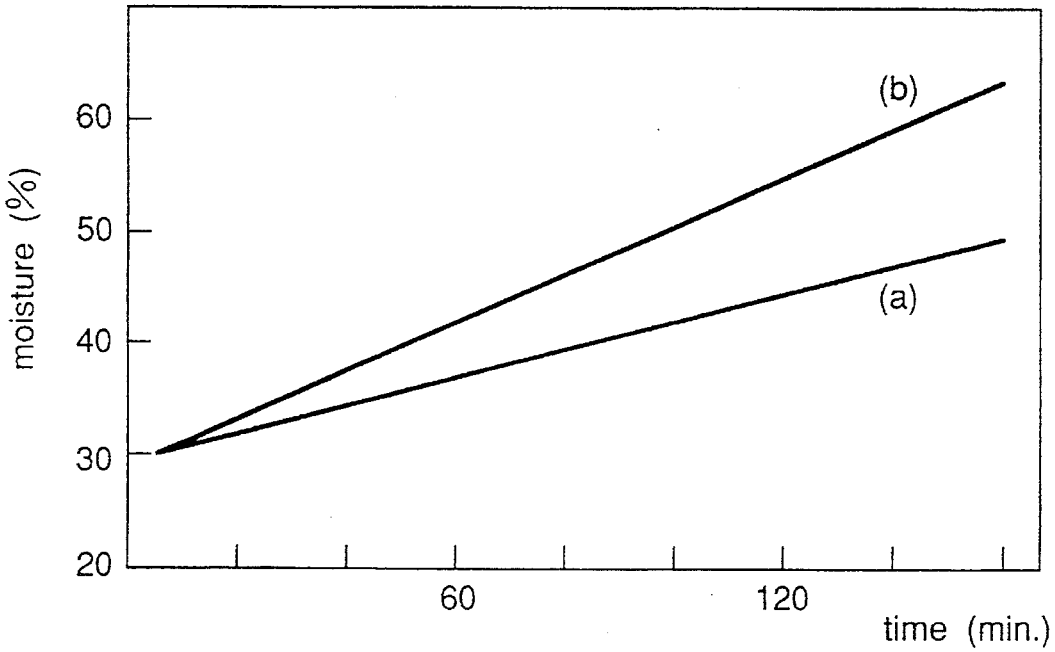

The results are shown in FIG. 3. FIG. 3 (A) is a graph illustrating test results under a constant humidity (70% RH). FIG. 3 (B) is a graph illustrating test results under a constant temperature (25° C.).

The processed product of Example 3 showed a pleasant effect due to the moisture adsorption effect, but panty hose of Comparative Example 2 afforded a stuffy feeling.

(3) Evaluation of Water Absorption Properties

Figure 4:
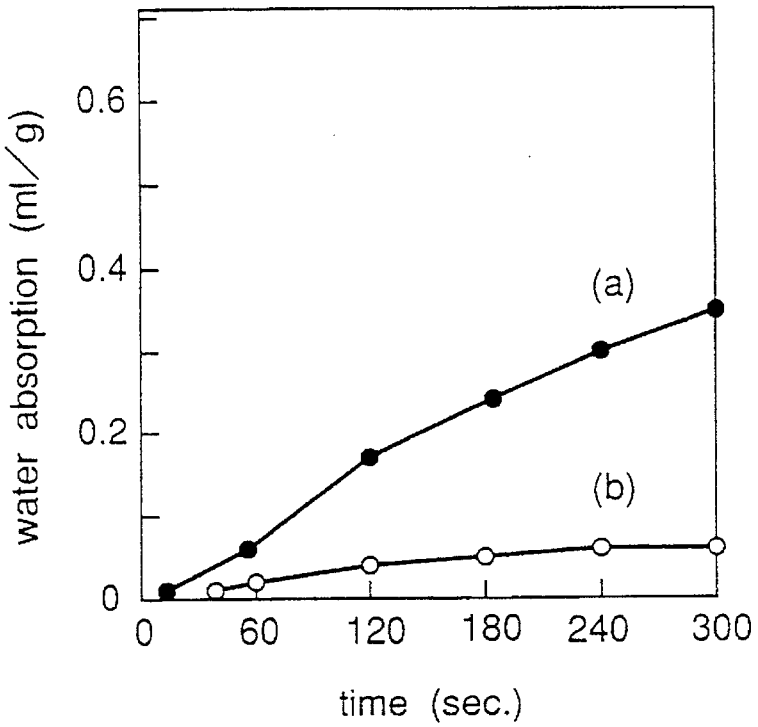
FIG. 4 is a graph illustrating a comparison in absorbing rate between textile products of the present invention (Example 1) and Comparative Example (Comparative Example 2), wherein (a) is Example 1 and (b) is Comparative Example 2.

In order to confirm the improvement of water absorption properties due to the wool protein treatment of the present invention, a water absorption rate was evaluated according to a Larose process, using an water absorption measuring apparatus KM350-P10N manufactured by Kyowa Seiko Co., Ltd. The results are shown in FIG. 4.

As the sample, panty hose of Example 1 and Comparative Example 2 (for comparison) were used.

It is apparent that the water absorption rate of the textile product subjected to the treatment of the present invention is considerably large in comparison with a product which is not subjected to the treatment of the present invention.

(4) Evaluation of Moisture Uptake

Figure 5:
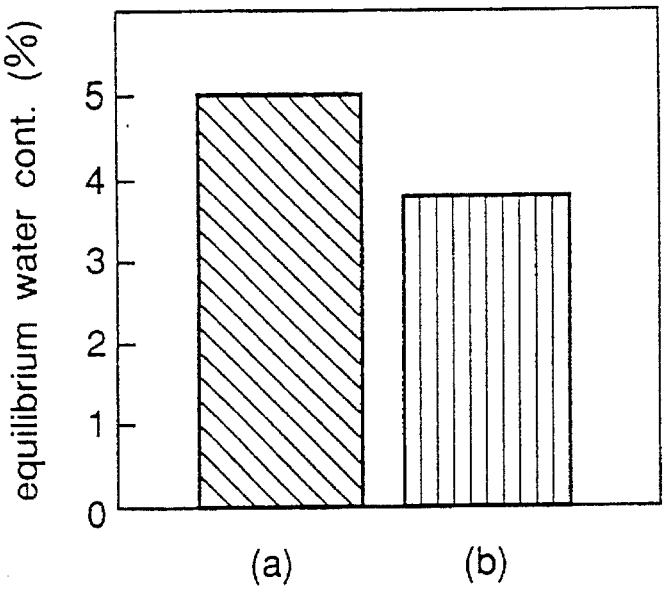
FIG. 5 is a graph illustrating an equilibrium water content of textile products of the present invention (Example 3) and Comparative Example (Comparative Example 2), wherein (a) is Example 3 and (b) is Comparative Example 2.

An equilibrium water content of panty hose placed under a standard condition (temperature: 20° C., humidity: 65%) was measured. The results are shown in FIG. 5.

The equilibrium water content of the panty hose of Example 3 of the present invention was 5.0% by weight and that of Comparative Example 2 was 3.9% by weight. It is shown that the textile product of the present invention has a high moisture uptake.

(5) Evaluation of Water Absorption/Moisture Exhalation Properties

Figure 7:
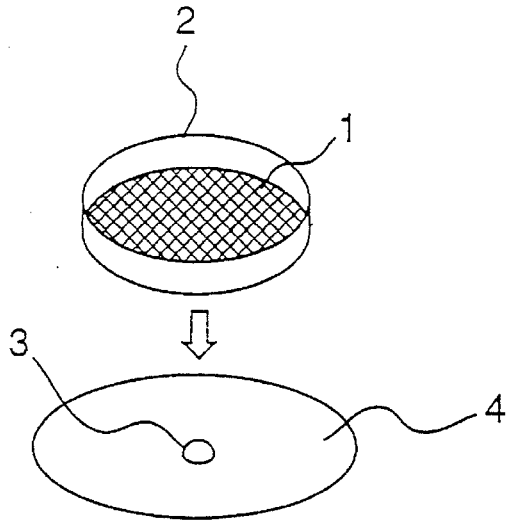
FIG. 7 is a schematic diagram illustrating a method for moisture exhalation properties test.

A test of moisture exhalation properties of panty hose was carried out in a temperature controlling room maintained at 20° C. (65% RH) using the apparatus shown in FIG. 7.

Panty hose were mounted on a retaining mold while stretching to the same size and the resulting sample was placed on a water drop (1 cc, 1 g) formed on a polyvinyl chloride sheet. Immediately after that, a decrease in weight was measured with time. This decrease in weight has a relation with moisture exhalation properties of water to be absorbed into panty host, and the moisture exhalation properties (moisture exhalation rate) were evaluated by the gradient of the graph.

Figure 6:
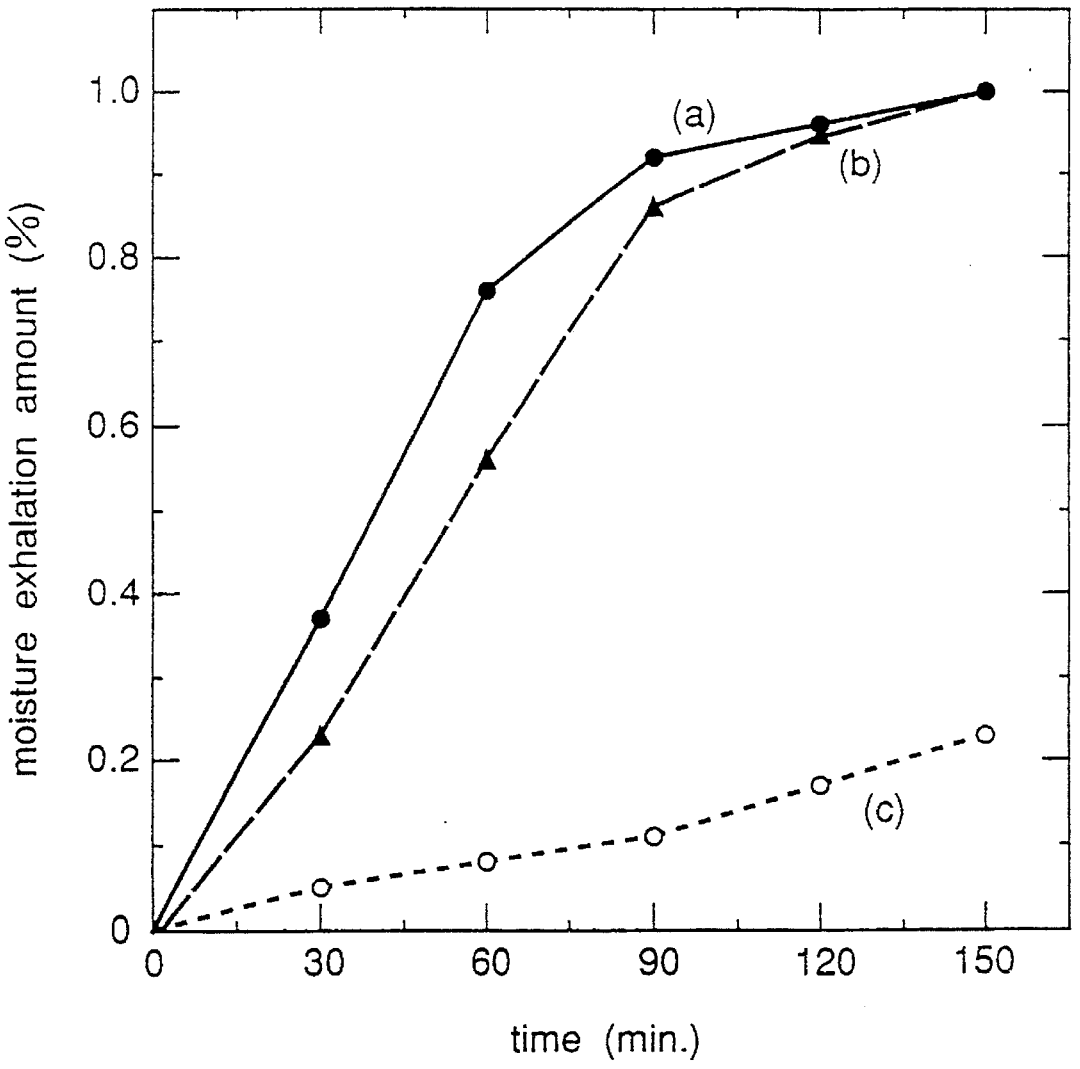
FIG. 6 is a graph illustrating a comparison in moisture exhalation properties (drying rate) between textile products of the present invention (Example 1) and Comparative Example (Comparative Examples 1 and 2), wherein (a) is Example 1, (b) is Comparative Example 1 and (c) is Comparative Example 2.

The sample of Example 1 is superior in water absorption/diffusion properties as shown in Table 1 and is also superior in moisture exhalation properties as shown in FIG. 6. On the other hand, the sample of Comparative Example 2 is inferior in moisture absorption/diffusion properties (Table 1) and is also inferior in water exhalation properties (FIG. 6). The sample of Comparative Example 1 is comparatively superior in moisture absorption/exhalation properties, but is inferior in water exhalation rate to the sample of Example 1. As described above, the panty hose of Example 1 shows a pleasant wear feeling.

(6) Evaluation of Washing Resistance

Panty hose obtained in Examples 1 to 5 and Comparative Examples 1 to 2 were subjected to a washing treatment using the method according to JIS L0217 104. Water absorption properties of the panty hose before and after washing were evaluated by a dropping method defined in JIS L 1018. The results are shown in Table 1. The panty hose (Examples 1, 3, 4 and 5) as the textile products of the present invention absorbed water and diffused, rapidly, after washing treatment. The panty hose of Example 2, which was not subjected to a preliminary treatment due to chitosan, showed excellent water absorption properties and diffusion properties before washing, but showed no water absorption properties after washing and are liable to repel water. The product of Comparative Example 1 was liable to absorb water, but the water absorption properties were low in comparison with Examples 1 to 5.

TABLE 1

| | Example 1 | | Example 2 | | Example 3 | | Example 4 | |
|---|---|---|---|---|---|---|---|---|
| | Not washed | Washed | Not washed | Washed | Not washed | Washed | Not washed | Washed |
| Immediately after dropping | ○ | ○ | ○ | X – Δ | ○ | ◎ | ○ | ○ |
| 30 Seconds after dropping | ◎ | ◎ | ◎ | X – Δ | ◎ | ◎ | ◎ | ◎ |

TABLE 1-continued

| | Example 5 | | Comparative Example 1 | | Comparative Example 2 | |
|---|---|---|---|---|---|---|
| | Not washed | Washed | Not washed | Washed | Not washed | Washed |
| Immediately after dropping | ○ | ○ | Δ | Δ | X | ○ |
| 30 Seconds after dropping | ⊙ | ⊙ | Δ | Δ | X – Δ | X – Δ |

Washing condition: Method according to JIS L 0217 104 (10 times)
Evaluation of panty hose before and after washing [Criteria]
⊙: Diffusion of water arises.
○: Water is rapidly absorbed.
Δ: Water is liable to be absorbed.
X – Δ: Water is liable to be repelled.
X: Water repelling (7) Evaluation of Antibacterial Properties A comparison between antibacterial properties of the panty hose (non-washed product, product after washing five times) of Example 3 and panty hose (non-washed product) of Comparative Example 3 were made. Furthermore, a standard nylon cloth was used as a non-processed standard sample. The measurement data of the antibacterial properties are shown in Table 2. As is apparent from Table 2, the product using the wool protein and chitosan of the present invention shows excellent antibacterial properties even after washing.

TABLE 2

| | Antibacterial properties | | |
|---|---|---|---|
| Sample | Increase/decrease ratio of viable microbe cell number | Increase/decrease value of viable microbe cell number | Difference in increase/decrease ratio of viable microbe cell number |
| Example 3 (Non-washed) | $3.2 \times 10^{-1}$ | –0.5 | 3.6 |
| Example 3 (After washing five times) | $4.0 \times 10^{-1}$ | –0.4 | 3.5 |
| Comparative Example 3 (Non-washed) | $7.9 \times 10^{2}$ | 2.9 | 0.2 |
| Non-processed sample* | $1.3 \times 10^{3}$ | 3.1 | — |

*A standard nylon white cloth was used as the non-processed sample.

[Test method] Manual for processing effect evaluation test of product subjected to antibacterial/deodorizing processing: method for measuring viable microbe cell number (Conference of Sanitary Processing of Textile Products, 1988)

The following bacteria were suspended in a sterilized liquid bouillon, and 0.2 ml of the resulting solution (viable microbe cell number: about 410,000) was inoculated on a test piece (0.2 g). After culturing at 37° C. for 18 hours, the test piece was removed. The number of viable microbe cells on the test piece before and after culturing was measured, and the increase/decrease ratio, increase/decrease value and difference in increase/decrease ratio of the viable microbe cell number were calculated using the following calculation formula.

Bacteria to be tested: *Staphylococcus aureus* ATCC 6538P (IFO 12732)

Weight of test piece: 0.2 g

Culturing temperature/time: 37° C.×18 hours

Washing method: according to JIS L 0217, No.103 (Incidentally, a neutral detergent "Monogen Uni" (synthetic detergent available from P & G) was used.)

Increase/decrease ratio of viable microbe cell number =

$$\frac{\text{Numbers of viable microbe cells on test piece after culturing for 18 hours}}{\text{Numbers of viable microbe cells immediately before culturing (numbers of viable microbe cells to be inoculated)}}$$

Increase/decrease value of viable microbe cell number =

$$\text{Log}_{10}\frac{\text{Numbers of viable microbe cells on test piece after culturing for 18 hours}}{\text{Numbers of viable microbe cells immediately before culturing (numbers of viable microbe cells to be inoculated)}}$$

Difference in increase/decrease ratio of viable microbe cell number =

Figure 8:
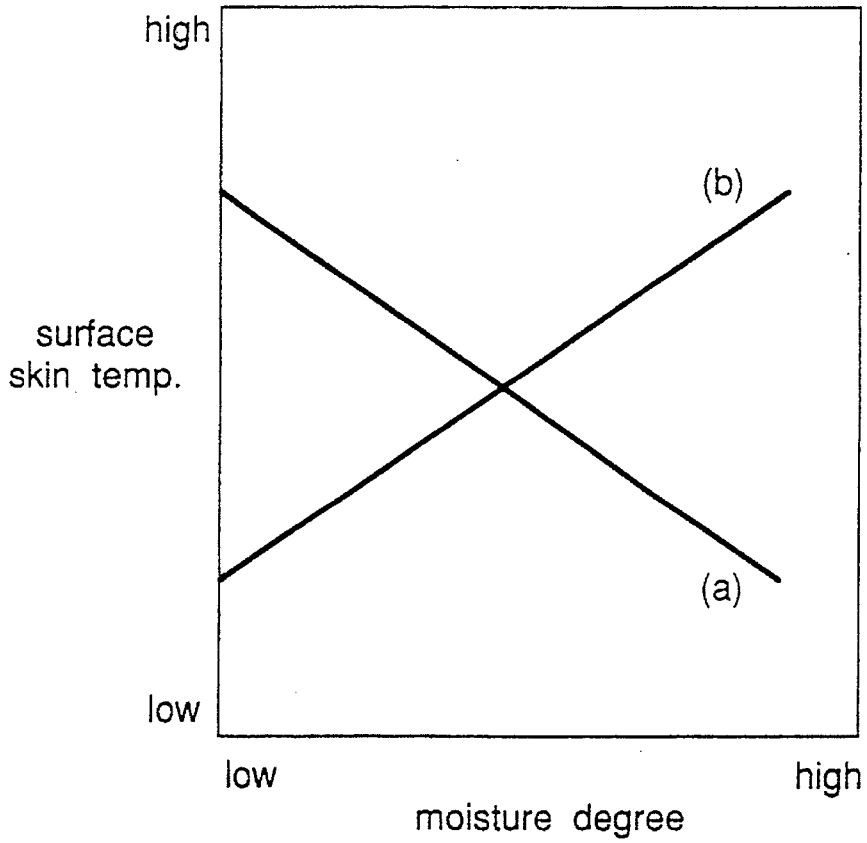
FIG. 8 is a graph illustrating a comparison in relation between the surface skin temperature and temperature in clothes on wearing of textile products of the present invention (Example 3) and Comparative Example (Comparative Examples 2), wherein (a) is Example 3 and (b) is Comparative Example 2.

Increase/decrease value of viable microbe cell number of non-processed sample – Increase/decrease value of viable microbe cell number of processed sample (8) Thermal and Thermolysis Effect A relation between the temperature in clothes and surface skin temperature at the time of loading of the panty hose of Example 3 and Comparative Example 2 was determined and calculated, respectively. Measurement environmental temperature was set at 26°±1° C. Loading due to an ergometer was applied at a state where a person is wearing a test product and an athletic wear thereon, and the surface skin temperature at the time when the athletic wear are taken off was evaluated, respectively. As a result, as is shown in FIG. 8, the product of Comparative Example 2 (plot (b)) is high in surface skin temperature to the product of Example 3 (plot (a)) and shows a thermal effect in the evaluation immediately after loading where perspiration is little. However, when perspiration is enhanced by loading, the product of Example 3 shows a large thermolysis effect in comparison with Comparative Example 2. Accordingly, the panty hose of the present invention are pleasant due to the following reason. That is, perspiration is little when it is cold and, therefore, the skin temperature does not decrease due to the thermal effect. On the other hand, perspiration is large when it is hot and, therefore, the skin temperature decreases due to the thermolysis effect.

What is claimed is:

1. Polyurethane fibers or a textile product comprising polyurethane fibers on which a water-soluble wool protein is adsorbed.

2. The polyurethane fibers or textile product according to claim 1, wherein the wool protein is a water-soluble wool protein obtained by subjecting a wool to oxidation cleavage in a weak alkaline liquid medium containing an oxidizing agent.

3. The polyurethane fibers or textile product according to claim 2, wherein the oxidizing agent is hydrogen peroxide.

4. The polyurethane fibers or textile product according to claim 1, wherein said textile product comprises panty hose.

5. The polyurethane fibers or textile product according to claim 2, wherein said textile product comprises panty hose.

6. The polyurethane fibers or textile product according to claim 3, wherein said textile product comprises panty hose.

7. A process for producing the polyurethane fibers or textile product of claim 1, which comprises dipping polyurethane fibers or a textile product containing polyurethane fibers in a water-soluble wool protein solution to selectively adsorb the water-soluble wool protein on the polyurethane fibers.

8. A process for producing the polyurethane fibers or textile product of claim 4, which comprises dipping polyurethane fibers or pantyhose containing polyurethane fibers in a water-soluble wool protein solution to selectively adsorb the water-soluble wool protein on the polyurethane fibers.

9. The process according to claim 7, wherein the polyurethane fibers or textile product containing polyurethane fibers are subjected to a preliminary treatment by dipping in a chitosan solution before dipping in said water-soluble wool protein solution, or chitosan is present in the wool protein solution.

10. The process according to claim 7, wherein the water-soluble wool protein is a water-soluble wool protein obtained by subjecting a wool to oxidation cleavage in a weak alkaline liquid medium containing an oxidizing agent.

11. The process according to claim 10, wherein the oxidizing agent is hydrogen peroxide.

12. The process according to claim 9, wherein the water-soluble wool protein is a water-soluble wool protein obtained by subjecting a wool to oxidation cleavage in a weak alkaline liquid medium containing an oxidizing agent.

13. The process according to claim 12, wherein the oxidizing agent is hydrogen peroxide.

* * * * *